United States Patent [19]

Wenrick

[11] Patent Number: 5,069,940

[45] Date of Patent: Dec. 3, 1991

[54] APPARATUS AND METHOD FOR APPLYING COATING MATERIAL

[75] Inventor: Jarod D. Wenrick, Miami County, Ohio

[73] Assignee: Creative Extruded Products, Inc., Tipp City, Ohio

[21] Appl. No.: 591,391

[22] Filed: Oct. 1, 1990

[51] Int. Cl.[5] ..... B05D 5/00; B05D 1/08; B05C 1/02

[52] U.S. Cl. ..... 427/284; 118/204; 118/210; 118/252

[58] Field of Search ..... 118/204, 210, 252; 427/284

[56] References Cited

U.S. PATENT DOCUMENTS 4,110,490 8/1978 Westberg ..... 427/284 X

*Primary Examiner*—Evan Lawrence

*Attorney, Agent, or Firm*—Reuben Wolk

[57] ABSTRACT

An apparatus and method for applying liquid coating material to the end surfaces of decorative members such as body side molding strips or the like. The apparatus comprises a rotating wheel mounted on a horizontal shaft so that a portion of the wheel extends above a table surface. The decorative members are placed on the table surface so that the end surfaces contact the sides of the wheel, which pick up coating material from a supply source during rotation. By controlling the viscosity of the coating material and the speed of rotation of the wheel, the amount of coating material applied to the end surfaces may be controlled.

18 Claims, 1 Drawing Sheet

APPARATUS AND METHOD FOR APPLYING COATING MATERIAL

BACKGROUND OF THE INVENTION

The present invention relates to an apparatus and method for applying liquid coating material to the end surfaces of decorative members such as body side molding, body side molding inserts, or body side trim strips. The material is required to seal the ends of these members to protect them against exposure to the elements.

PRIOR ART STATEMENT

It is customary to use purely manual methods in applying liquid coating material to decorative members; for example, the operator merely dips a cotton-tipped swab in a container of the material, holds the member in his other hand, and dabs the material on the desired end surface. Such a procedure is very ineffective from a time standpoint and does not provide an even coating of material on the surface. This procedure tends to spread an excessive amount of overflow material on adjacent surfaces of the member, and this is unacceptable to the customer.

SUMMARY OF THE INVENTION

The purpose of the novel apparatus and method herein described and claimed is to provide consistent, controlled application of coating material to the end surfaces of decorative members, and to do so in an efficient manner. This is accomplished by mounting a wheel preferably made of a hard non-porous plastic material on a horizontal shaft secured to the underside of a work table, a portion of the wheel extending above the table. The wheel rotates at right angles to the table. Liquid coating material is fed into a reservoir below the table, the wheel rotating into the reservoir and bringing up some of the material which adheres to the sides of the wheel, so that the portion of the wheel above the table makes the material accessible.

The decorative members are then placed on the table so that the end surfaces contact the sides of the wheel to pick up the desired amount of coating material. The amount of material to be picked up is controlled by either or both of two systems; the speed of rotation of the wheel and the viscosity of the material.

It is therefore a principal object of the invention to provide an apparatus for applying liquid coating material to the end surfaces of decorative members.

It is a further object to control the amount of material being applied.

It is another object to apply an even coating of the coating material in a simple and efficient manner.

It is yet another object to apply the coating material so that it will not extend into adjacent portions of the decorative members where it is not desired.

These and other details and features of the invention will become more readily apparent from the preferred embodiment described and shown herein.

DESCRIPTION OF THE PREFERRED EMBODIMENT

Figure 1:
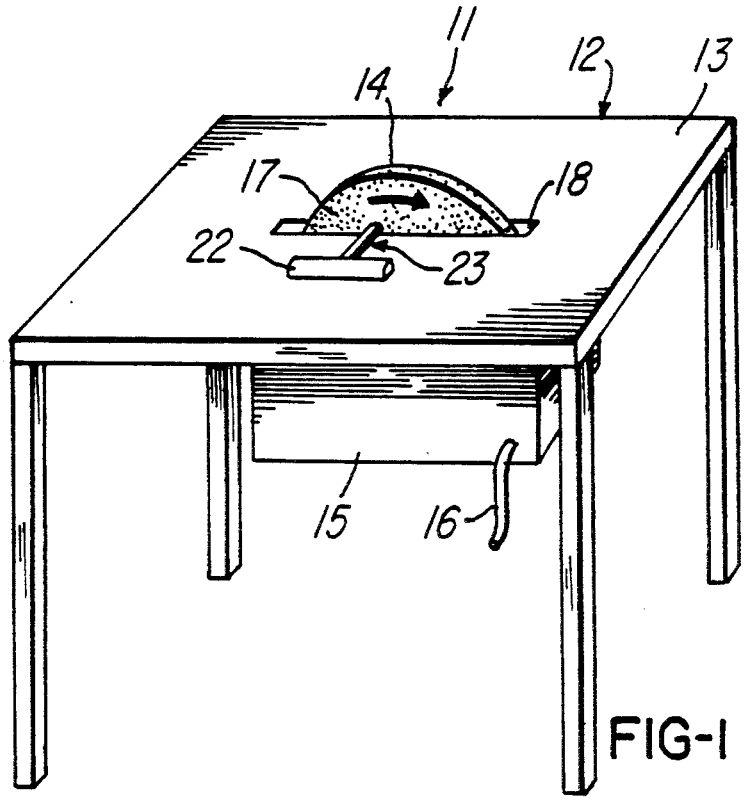
FIG. 1 is a perspective view of the novel apparatus for applying the coating material.
Figure 2:
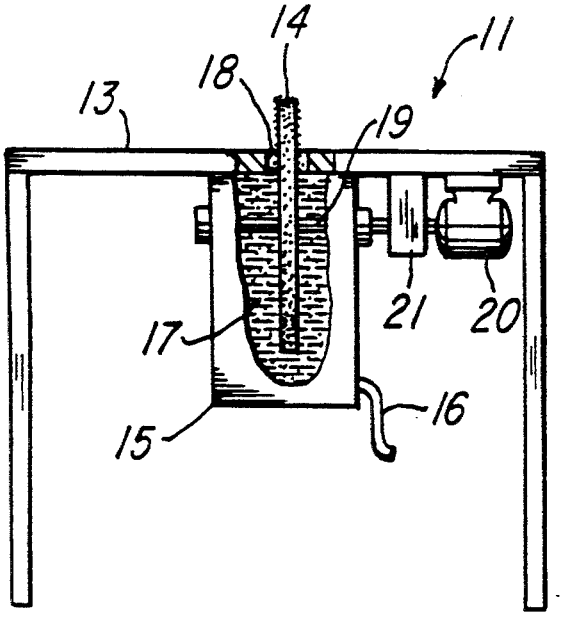
FIG. 2 is a side view of the novel apparatus.

Referring now to the drawings, FIGS. 1 and 2 illustrate the novel apparatus 11, comprising a table 12 with a flat top 13 serving as a working surface. Mounted to the under surface of the top is a reservoir 15 which contains the liquid coating material 17, this material being fed into the reservoir through the piping 16 from an outside mixing source (not shown). A wheel 14, made of a hard, non-porous plastic such as Delrin, nylon or ABS, is mounted on a central drive shaft 19 which is rotated by a motor 20 through a speed reducer 21. The drive shaft passes through the reservoir below the table top 13, and rotates the wheel which is immersed within the reservoir so that when the wheel is rotated it picks up some of the coating material on the sides of the wheel. The upper portion of the wheel extends through an aperture 18 in the table top so that the sides of the wheel with the coating material thereon is above the table top for use in carrying out the purposes of the invention.

The coating material 17 may be of any suitable composition which will act as a sealer to prevent exposure of the sealed surface to the elements. One example of a material that has been found satisfactory is manufactured by the Dorrie Process Company, a division of Hicks and Otis Prints, Inc., of Norwalk, Conn., and identified as MC-15. This material has a Brookfield viscosity in the range of 14 to 25 seconds, preferably about 18 seconds. The viscosity of the material will affect the amount that is applied to the wheel, and hence to the end surfaces of the decorative members. The material is supplied continuously through the piping 16, and the viscosity is controlled by the use of a thinner such as toluol.

The wheel 14 is rotated by the motor 20 at a comparatively slow speed which is controlled by regulating the rotation of the drive shaft 19 by means of the speed controller 21. It has been found that a range of one to ten revolutions per minute (RPM) of the wheel will produce the desired results, namely the application of the desired amount of coating material to the end surfaces of the decorative members. The viscosity of the material is generally in direct proportion to the speed of rotation of the wheel. Typical examples of this relationship are as follows:

| Viscosity in seconds | RPM |
|---|---|
| 8 | 1 |
| 12 | 2 |
| 16 | 3 |
| 18 | 4 |
| 21 | 5 |
| 23 | 6 |

As can be seen above, the amount of coating material which is supplied to the wheel from the reservoir may be controlled by either regulating the viscosity of the coating material by thinning it; or by regulating the speed of rotation of the wheel; or by both. The operator is thus in a position to exercise complete control of the coating operation in order to apply exactly the amount of coating material desired to the end surfaces, without permitting an excessive overflow onto adjacent surfaces where it is not desired. It should be understood that this feature is very important because the purchaser of the decorative member has established rigorous specifications which limit the amount of overflow onto decorative surfaces, because such overflow will adversely affect the cosmetic appearance of the member.

Figure 3:
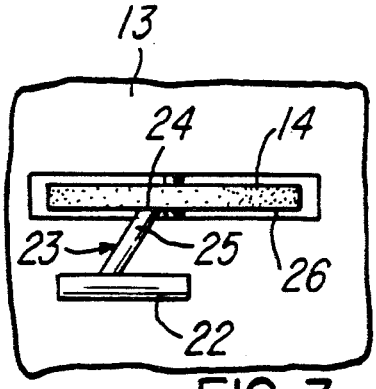
FIG. 3 is a plan view illustrating a portion of the apparatus for application of the coating material to the end surfaces of the decorative members.

In order to to utilize the apparatus, the operator turns on the motor and adjusts the speed of rotation of the wheel until he feels that the coating material on the sides of the wheel has the proper viscosity for application to the end surfaces. He then places the member 23 on the table top so that the end 24 is in contact with the side 26 of the wheel, thus permitting the end surface to be coated. The operator may simply hold the member by hand while applying the necessary pressure for coating, or he may optionally utilize an adjustable guide 22 to feed the member against the wheel. This operation is also shown in FIG. 3 in plan view. As stated above, the operator must avoid allowing the coating material to overflow onto an adjacent surface of the member, such as the top 25. The operator then removes the end-coated member and repeats the operation with other members. The wheel continues to rotate into the reservoir and pick up coating material for the operation. If the operator finds that the viscosity is incorrect, he has the option of thinning the coating material, changing the speed of rotation, or both. It should be understood that two operators may work on the table st the same time, each using a opposite side of the wheel, since both sides will pick up the coating material from the reservoir.

Figure 4:
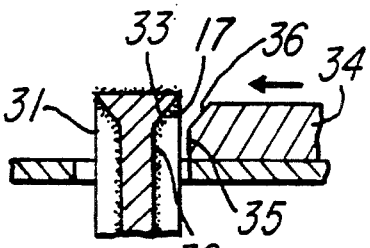
FIG. 4 is an enlarged sectional view of a modified form of wheel which applies the coating material, and a corresponding decorative member.

The novel apparatus provides the additional feature of versatility in being able to coat the ends of decorative members which have odd shapes. The wheel may be designed to accomodate such shapes and to apply the material evenly, even when the end surfaces are in different planes. A typical example is shown in FIG. 4, in which a decorative member 34 has an end surface 35 and a beveled surface 36, both of which require application of coating material. In this configuration the wheel 31 has a side 32 and a shoulder 33 which correspond to the surfaces 35 and 36. The wheel 31 is operated in the same manner as the wheel 14, and picks up coating material 17 from the reservoir. When the member 34 is pressed into contact with the wheel, the coating material is applied only to the desired surfaces and overflow is avoided.

Other modifications and variations of the above described apparatus and method may be made within the scope of the present invention.

I claim:

1. An apparatus for applying liquid coating material to the end surface of a decorative member, comprising a wheel having a central supporting shaft, means for supplying coating material to at least one side face of said wheel, means for rotating said wheel about said shaft, a flat working surface on which said member is placed, said surface being approximately at right angles to said side face, and means for feeding said member placed on said flat working surface so that said end surface contacts said side face to apply coating material to said end surface.

2. The apparatus of claim 1 wherein said wheel is composed of a non-porous plastic material.

3. The apparatus of claim 1 wherein said wheel is shaped to conform with the configuration of said end surface.

4. The apparatus of claim 1 wherein said flat working surface has an aperture, said wheel extending through said aperture so that a portion thereof extends above the surface.

5. An apparatus for applying a liquid coating material to the end surface of a decorative member, comprising a wheel having a central supporting shaft, means for supplying coating material to at least one side face of said wheel, means for rotating said wheel about said shaft, and means for feeding said member so that said end surface contacts said side face to apply coating material to said end surface, said supplying means comprising a coating material reservoir adjacent said wheel, said wheel extending into said reservoir to supply said coating material to said side face.

6. The apparatus of claim 1 further comprising means for controlling the amount of coating material supplied to said wheel.

7. The apparatus of claim 6 wherein said controlling means comprises means for regulating the speed of rotation of said wheel.

8. The apparatus of claim 7 wherein said speed of rotation is no greater than ten revolutions per minute.

9. The apparatus of claim 6 wherein said controlling means comprises means for regulating the viscosity of said coating material.

10. The apparatus of claim 9 wherein said viscosity is in the range of 14 to 25 seconds on the Brookfield Viscosity Scale.

11. The apparatus of claim 6 wherein said controlling means comprises means for regulating the speed of rotation of said wheel and also means for regulating the viscosity of said coating material.

12. The apparatus of claim 11 wherein said viscosity increases in direct proportion to said speed of rotation.

13. A method of applying liquid coating material to the end surface of a decorative member, comprising the steps of supplying said coating material to at least one side face of a wheel, rotating said wheel, holding said member against said side face to apply coating material to said end surface, providing a flat working surface approximately at right angles to said side face of said wheel, and placing said member on said surface in contact with said side face of said wheel to apply coating material to said end surface.

14. The method of claim 13 comprising the further steps of providing a coating material reservoir adjacent said wheel, and rotating said wheel in said reservoir to supply coating material to at least one side face of said wheel.

15. The method of claim 13 comprising the further step of controlling the amount of coating material supplied to the wheel.

16. The method of claim 15 wherein said controlling step comprises regulating the speed of rotation of said wheel and the viscosity of said coating material.

17. The method of claim 16 wherein said speed of rotation is no greater than ten revolutions per minute and said viscosity is in the range of 14 to 25 seconds on the Brookfield viscosity scale.

18. The method of claim 16 wherein said viscosity increases in direct proportion to said speed of rotation.

* * * * *